US005964246A

United States Patent [19]

Meeker

[11] Patent Number: 5,964,246

[45] Date of Patent: Oct. 12, 1999

[54] OUTDOOR HOT AND COLD WATER FAUCET ASSEMBLY

[75] Inventor: Paul K. Meeker, Hiram, Ohio

[73] Assignee: Mecker R & D, Inc., Hiram, Ohio

[21] Appl. No.: 08/943,402

[22] Filed: Oct. 3, 1997

[51] Int. Cl.[6] ..... F16L 5/00

[52] U.S. Cl. ..... 137/360; 137/377; 137/382

[58] Field of Search ..... 137/377, 382, 137/360

[56] References Cited

U.S. PATENT DOCUMENTS

| | | | |
|---|---|---|---|
| 1,883,507 | 10/1932 | Bond et al. | 137/360 |
| 2,214,761 | 9/1940 | Cornell | 137/377 |
| 2,686,530 | 8/1954 | Dire | 137/375 |
| 2,952,271 | 9/1960 | Dick et al. | 137/360 |
| 2,985,552 | 5/1961 | Watanabe | 154/44 |
| 3,175,575 | 3/1965 | Kennedy | 137/360 |
| 3,411,541 | 11/1968 | Hindman et al. | 137/637.2 |
| 3,718,154 | 2/1973 | Doumany | 137/360 |
| 4,071,043 | 1/1978 | Carlson | 137/375 |
| 4,103,701 | 8/1978 | Jeng | 137/375 |
| 4,244,394 | 1/1981 | Hartselle, III | 137/375 |
| 4,380,245 | 4/1983 | Hefner | 137/375 |
| 4,456,027 | 6/1984 | Belgard | 137/375 |
| 4,644,970 | 2/1987 | Lowry | 137/625.41 |
| 4,947,025 | 8/1990 | Alston et al. | 219/303 |
| 5,261,444 | 11/1993 | Chiders | 137/360 |
| 5,305,785 | 4/1994 | Humber | 137/360 |
| 5,318,059 | 6/1994 | Lyons | 137/62 |
| 5,614,119 | 3/1997 | Ollis | 219/385 |

FOREIGN PATENT DOCUMENTS

| | | | |
|---|---|---|---|
| 974256 | 11/1964 | United Kingdom | 137/360 |

*Primary Examiner*—A. Michael Chambers
*Attorney, Agent, or Firm*—Oldham & Oldham Co., L.P.A.

[57] ABSTRACT

Outdoor hot and cold water faucet assembly having a mixing faucet which provides hot and/or cold water, or some combination thereof, which is enclosed in a housing having a hinged door which insulates and protects the outdoor hot and cold water faucet. The outdoor hot and cold water faucet assembly preferably includes a housing or enclosure having an outwardly facing opening and a cover member pivotally attached to the housing or enclosure, the cover member being capable of being closed on the outwardly facing opening in the housing or enclosure and also being capable of being opened from the outwardly facing surface to permit access to the interior of the housing or enclosure through the outwardly facing opening and an outdoor hot and cold water faucet having a hot and cold water control valve and a hot and cold water control handle, the hot and cold water control handle being positioned in the interior of the housing or enclosure.

20 Claims, 4 Drawing Sheets

OUTDOOR HOT AND COLD WATER FAUCET ASSEMBLY

BACKGROUND AND SUMMARY OF THE INVENTION

The present invention relates generally to a new and novel outdoor hot and cold water faucet assembly. More particularly, the present invention relates to a new and novel outdoor hot and cold water faucet assembly which is completely enclosed and makes hot and cold water available outdoors during all seasons while providing freeze and vandal protection for the outdoor hot and cold water faucet.

Outdoor water faucets are widely used in various residential, commercial and industrial structures and provide water for a variety of outside uses such as watering gardens and lawns, washing cars and driveways and entertaining children. Existing outdoor water faucets typically include an outwardly extending outlet or bib having threads on its outside diameter which correspond with the internal threads in a conventional hose coupling to allow water to be distributed through a hose to remote locations where it can be utilized as desired.

However, most conventional outdoor water faucets are connected only to the "cold" water supply. Thus, if hot water is desired outside, it is often necessary to, for example, fill buckets of water with hot water inside and carry the hot water outside. Another problem that exists with many existing outdoor water faucets is that they are susceptible to damage due to the expansion of water when it freezes, which can damage the outdoor water faucets and cause water loss once the damaged outdoor water faucet thaws. Thus, it is often advisable to drain such convention outdoor water faucets as the winter season approaches in many parts of this country and such outdoor water faucets are unavailable for use during the winter months. In addition, many existing outdoor water faucets have their operating handles unprotected and out in the open. This allows unauthorized individuals to have access to such outdoor water faucets and water can be used for unauthorized purposes, including stealing and/or wasting the water and causing water damage.

In order to preclude the water in outdoor water faucets from freezing during the winter months in many parts of the country, some outdoor water faucets have been designed with a long valve to move the seal and water inwardly into heated portions of a building structure, thus preventing the water from freezing. However, such "no-freeze" outdoor water faucets still have their operating handles unprotected and out in the open and are thus susceptible to unauthorized use. Furthermore, such "no-freeze" outdoor water faucets are typically only connected to the "cold" water feed supply.

U.S. Pat. No. 4,644,970 discloses an outdoor water faucet having a mixing faucet which provides hot and/or cold water and which is adaptable for frost-free installation. However, this exterior water faucet has its operating handle unprotected and thus is susceptible to unauthorized use. Further, the mechanical components of U.S. Pat. No. 4,644,970 are deeply recessed and thus difficult to service. The concept of a temporary enclosure which covers and insulates an outdoor water faucet from outside temperatures and freezing is disclosed in U.S. Pat. Nos. 4,244,394; 4,456,027; 4,380,245 and 4,071,043. However such temporary enclosures are generally removed during the summer months and when so removed leave the outdoor water faucet operating handles open and thus susceptible to unauthorized use. Furthermore, such outdoor water faucets are typically connected to only the "cold" water supply.

Accordingly, an object of the present invention is the provision of an outdoor hot and cold water faucet assembly which provides both hot and cold water, or a mixture thereof.

Another object of the present invention is the provision of an outdoor hot and cold water faucet assembly which provides protection against water freezing therein and is thus available for year around use even in parts of the country which experience freezing temperatures.

Yet another object of the present invention is the provision of an outdoor hot and cold water faucet assembly which encloses and covers the operating handle to provide protection against use by unauthorized individuals.

These and other objects of the present invention are attained by the provision of an outdoor hot and cold water faucet assembly having a mixing faucet which provides hot and/or cold water, or some combination thereof, which is enclosed in a housing having a hinged door which insulates and protects the outdoor hot and cold water faucet. The outdoor hot and cold water faucet assembly preferably includes a housing or enclosure having an outwardly facing opening and a cover member pivotally attached to the housing or enclosure, the cover member being capable of being closed on the outwardly facing opening in the housing or enclosure and also being capable of being opened from the outwardly facing opening in the housing or enclosure to permit access to the interior of the housing or enclosure through the outwardly facing opening and an outdoor hot and cold water faucet having a hot and cold water control valve and a hot and cold water control handle, the hot and cold water control handle being positioned in the interior of the housing or enclosure.

Other advantages and novel features of the present invention will become apparent in the following detailed description of the invention when considered in conjunction with the accompanying drawings.

DETAILED DESCRIPTION OF THE DRAWINGS

Figure 1:
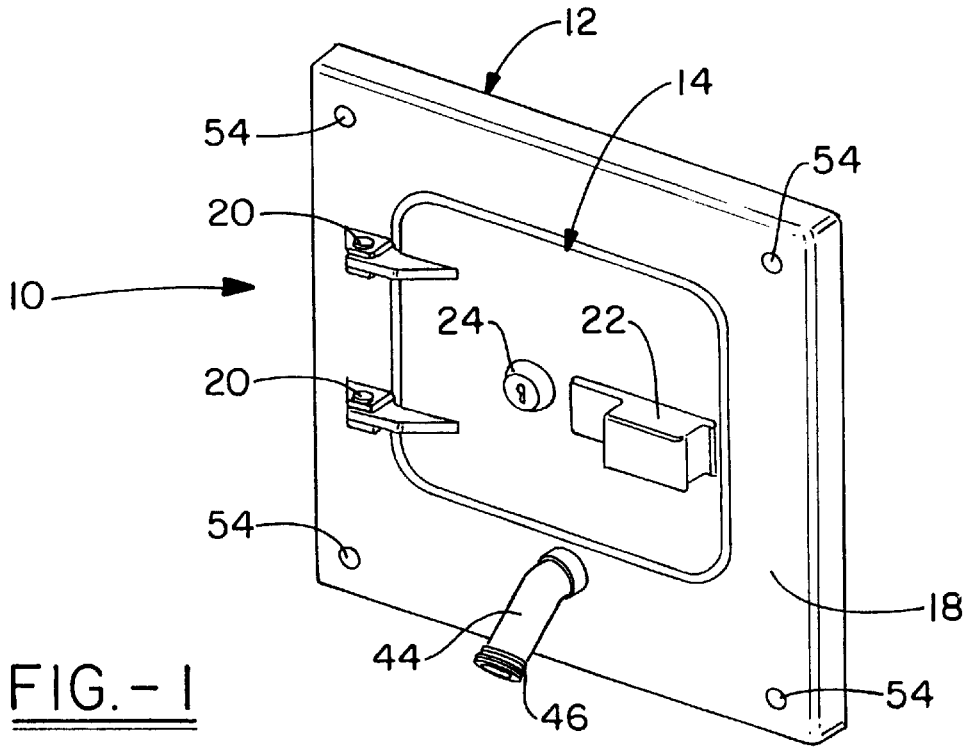
FIG. 1 illustrates a front perspective view of an outdoor hot and cold water faucet assembly with a hinged cover in a closed position in accordance with a first preferred embodiment of the present invention.

In the following detailed description of preferred embodiments of the present invention, reference is made to the accompanying drawings which, in conjunction with this detailed description, illustrate and describe a first preferred embodiment and a second preferred embodiment of an outdoor hot and cold water faucet assembly in accordance with the present invention. Referring first to FIGS. 1 through 4, which illustrate a first front perspective view, a second front perspective view, a rear perspective view and a front exploded perspective view, respectively, of an outdoor hot and cold water faucet assembly, generally identified by reference number 10, in accordance with a first preferred embodiment of the present invention, outdoor hot and cold water faucet assembly 10 generally includes housing or enclosure 12, cover member 14 and outdoor hot and cold faucet 16.

Figure 2:
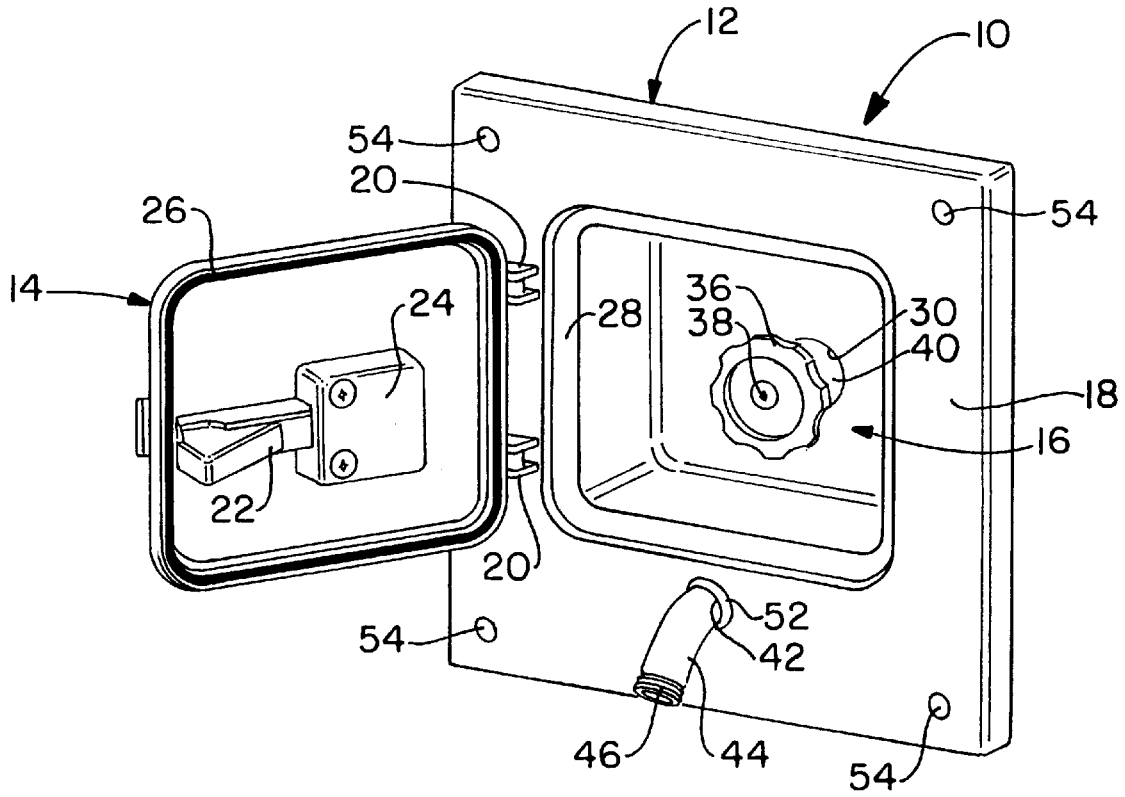
FIG. 2 illustrates a front perspective view of the outdoor hot and cold water faucet assembly with the hinged cover in an open position in accordance with the first preferred embodiment of the present invention shown in FIG. 1.

Referring to FIG. 2, housing or enclosure 12 is preferably fabricated as a molded plastic box open on one face and having flange 18 extending around the perimeter of the open face. Cover member 14 is preferably a plastic door having hinges 20 along one side thereof and is pivotally attached to housing or enclosure 12 to permit cover member 14 to open or close the open face in housing or enclosure 12. Cover member 14 also preferably includes latch member 22 positioned on the side of cover member 14 away from hinges 20 to permit cover member 14 to be secured to housing or enclosure 12 when cover member 20 closes the open face in housing or enclosure 12. Latch member 22 preferably includes interlocking surfaces to preclude the free passage of external air into the interior of housing or enclosure 12. In a particularly preferred embodiment of outdoor hot and cold faucet assembly 10, latch member 22 includes lock 24, such as a key or combination lock, which secures cover member 14 in the closed position over the open face in housing or enclosure 12 and precludes unauthorized individuals from opening cover member 14 from the open face of housing or enclosure 12.

Figure 3:
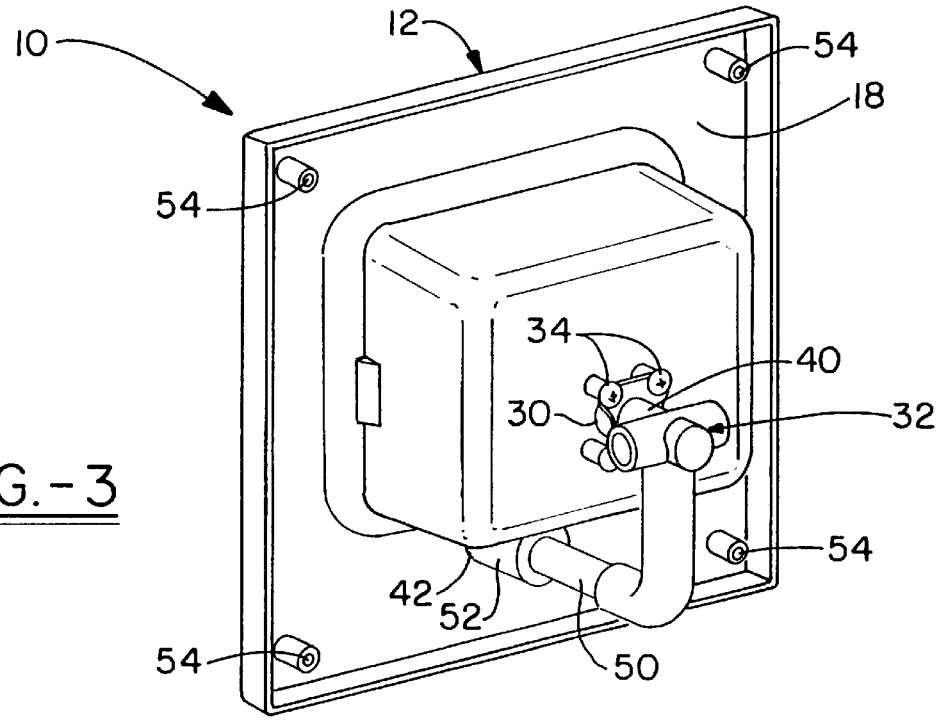
FIG. 3 illustrates a rear perspective view of an outdoor hot and cold water faucet assembly in accordance with the first preferred embodiment of the present invention shown in FIG. 1.
Figure 4:
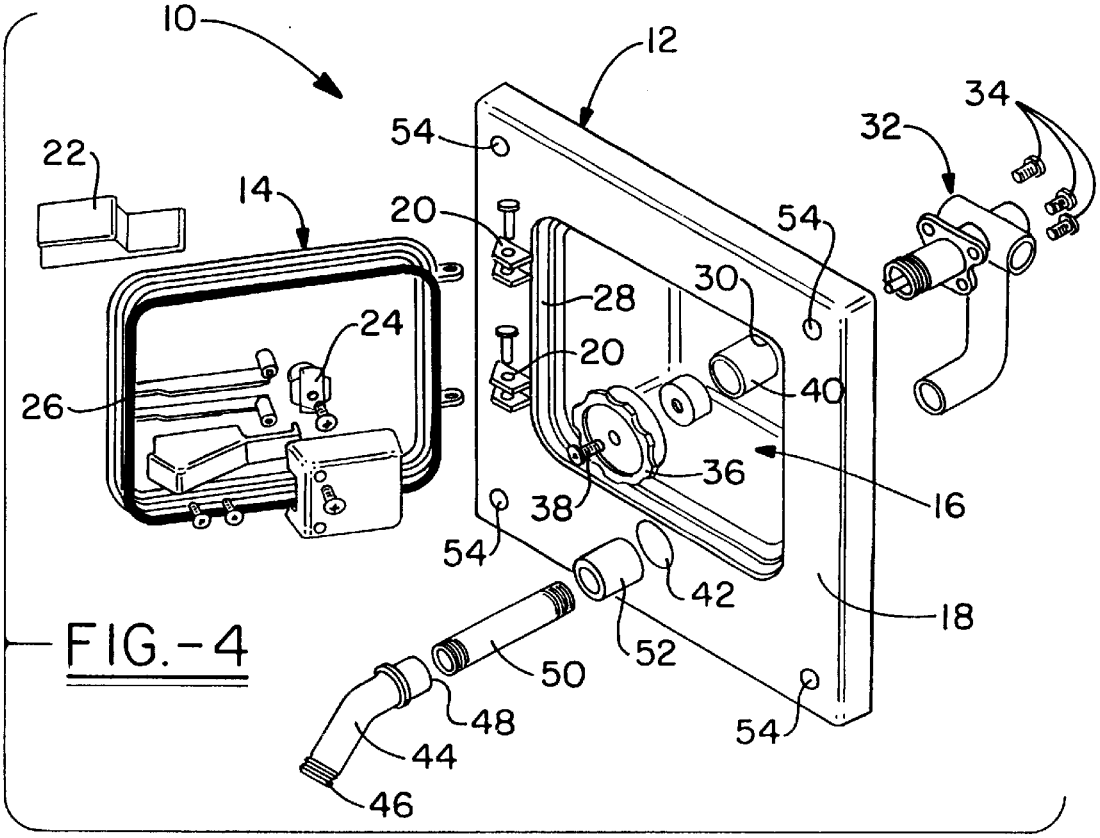
FIG. 4 illustrates an exploded front perspective view of an outdoor hot and cold water faucet assembly in accordance with the first preferred embodiment of the present invention shown in FIG. 1.
Figure 5:
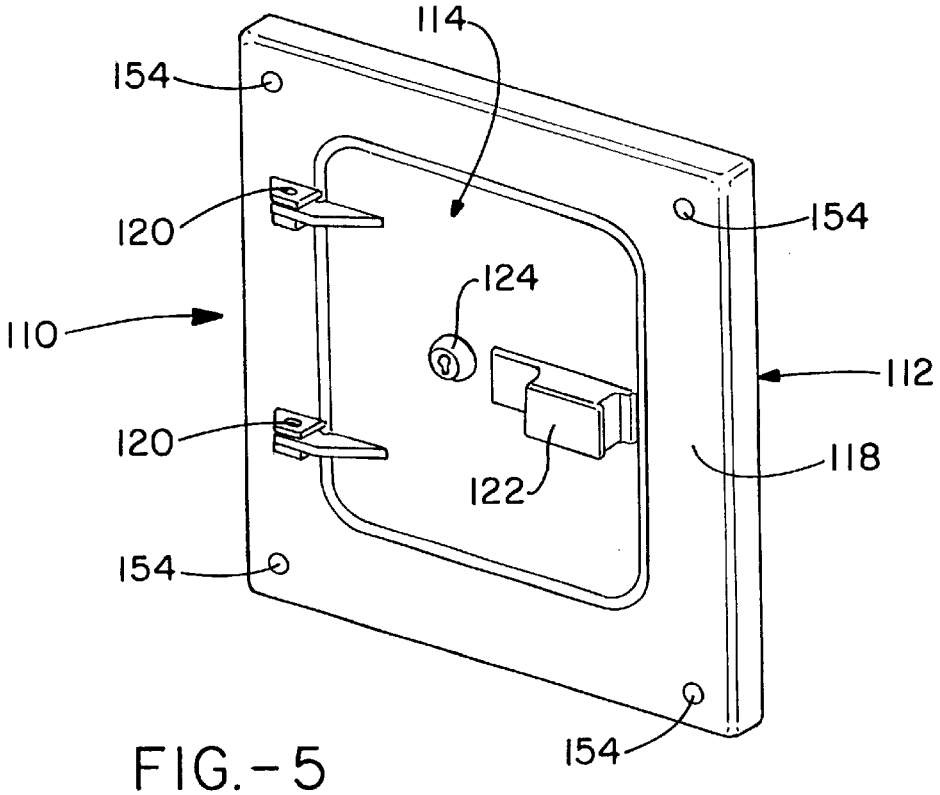
FIG. 5 illustrates a front perspective view of an outdoor hot and cold water faucet assembly with a hinged cover in a closed position in accordance with a second preferred embodiment of the present invention.

Sealing gasket 26 is preferably provided around the perimeter of the interior surface of cover member 14 and sealing gasket 26 seals against recessed lip 28 preferably present in flange 18 of housing or enclosure 12. If desired, sealing gasket 26 could be retained in a groove extending around the perimeter of the interior surface of cover member 14. The back of housing or enclosure 12, opposite to its open face, includes opening 30, which is preferably molded, through which hot and cold water control valve 32 extends. Hot and cold water control valve 32 is preferably a single handle shower-type water control valve or similar water valve, but, alternatively, two (2) standard hot and cold water valves and a mixer could be utilized if desired. As seen in FIGS. 3 and 4, hot and water control valve 32 is preferably mounted to the outside of the back of housing or enclosure 12, preferably by screws 34 or some other fasteners. Hot and cold water control handle 36 is mounted outwardly of hot and cold water control valve 32 as seen in FIG. 4 by screw 38 or some other type of fastener and hot and cold water control handle 36 is preferably positioned inside of housing or enclosure 12. If desired, hot and cold water control valve 32 could be fitted with insulating sleeve 40 as shown in FIG. 4 to minimize thermal convection from the heated space into the interior of housing or enclosure 12.

The lower portion of flange 18 of housing or enclosure 12 preferably includes opening 42, which is preferably a molded opening, through which a section of hose bib pipe 44, preferably fabricated from a metallic material, extends. Hose bib pipe 44 preferably includes external threads 46, such as standard male hose threads, on its outer end and internal threads 48 on its inner end. The inner end of hose bib pipe 44 and the output of hot and cold water control valve 32 are preferably connected with sections of threaded pipe. At least one section of this connecting pipe is preferably fabricated from a non-metallic material, such as plastic, to provide a thermal barrier. This non-metallic pipe section 50 is preferably attached to the inner end of hose bib pipe 44 and at least a portion of hose bib pipe 44, as well as an adjoining section of non-metallic pipe section 50, is preferably enclosed in insulating sleeve 52 at least in the vicinity where hose bib pipe 44 and/or non-metallic pipe section 50 extend through flange 18 of housing or enclosure 12 to provide an additional thermal barrier between the outside and the inside of the structure on which outdoor hot and cold faucet assembly 10 is mounted. This thermal barrier between hose bib pipe 44 and hot and cold water control valve 32 prevents water from freezing in hot and cold water control valve 32 and also precludes the conduction of heat from the interior of the structure on which outdoor hot and cold faucet assembly 10 is mounted to the exterior through outdoor hot and cold faucet assembly 10.

Placement of hot and cold water control valve 32 behind housing or enclosure 12 places it on the "warm" side of the structure on which outdoor hot and cold water faucet assembly 10 is mounted and insulating sleeve 40 around hot and cold water control valve 32 further insulates hot and cold water control valve 32, thus insulating hot and cold water control valve 32 and hot and cold water supply lines (not shown) from outside temperatures and preventing freezing of water therein. In addition, the thermal barriers described above, along with housing or enclosure 12, preclude heat loss from the interior of the structure on which outdoor hot and cold water faucet assembly 10 is mounted. Cover member 14 also acts as an insulator for hot and cold water control valve 32, yet can be readily opened in any season to permit hot and/or cold water to be used outdoors. When cover member 14 is opened, hot and cold water control handle 36 can be opened and adjusted to cause the proper flow rate and temperature of water to pass through hot and cold water control valve 32. When cover member 14 is closed, hot and cold water control valve 32 is again insulated from the outside environment. Furthermore, when hot and cold water control valve 32 is closed, water drains from the output end of hose bib pipe 44 and its associated plumbing, thus preventing freezing of water in the sections of plumbing connecting hot and cold water control valve 32 with hose bib pipe 44. The face of housing or enclosure 12 is preferably provided with four (4) holes or openings 54 which can be used to mount housing or enclosure 12 into an opening in a structure measuring approximately eight (8) inches by eight (8) inches in, for example, a concrete block wall, a stud wall or to the band of a building. In addition, the rear portion of housing or enclosure 12 could be covered with Styrofoam or some other insulative material if desired to add further thermal protection and insulation.

Referring now to FIGS. 5 through 8, which illustrate a first front perspective view, a second front perspective view, a rear perspective view and a front exploded perspective view, respectively, of an outdoor hot and cold water faucet assembly, generally identified by reference number 110, in accordance with a second preferred embodiment of the present invention, outdoor hot and cold water faucet assembly 110 generally includes housing or enclosure 112, cover member 114 and outdoor hot and cold faucet 116.

Figure 6:
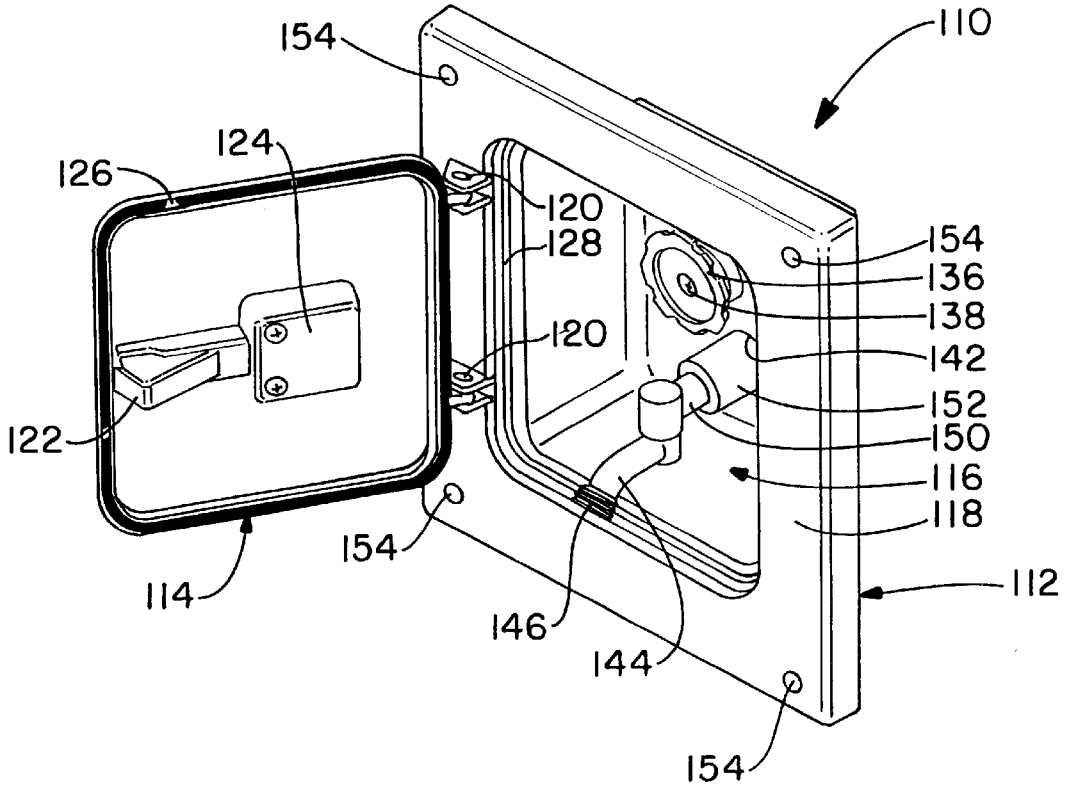
FIG. 6 illustrates a front perspective view of the outdoor hot and cold water faucet assembly with the hinged cover in an open position in accordance with the second preferred embodiment of the present invention shown in FIG. 5.

Referring to FIG. 6, housing or enclosure 112 is preferably fabricated as a molded plastic box open on one face and having flange 118 extending around the perimeter of the open face. Cover member 114 is preferably a plastic door having hinges 120 along one side thereof and is pivotally attached to housing or enclosure 112 to permit cover member 114 to open or close the open face in housing or enclosure 112. Cover member 114 also preferably includes latch member 122 positioned on the side of cover member 114 away from hinges 120 to permit cover member to be secured to housing or enclosure 112 when cover member 120 closes the open face in housing or enclosure 112. Latch member 122 preferably includes interlocking surfaces to preclude the free passage of external air into the interior of housing or enclosure 112. In a particularly preferred embodiment of outdoor hot and cold faucet assembly 110, latch member 122 includes a lock 124, such as a key or combination lock, which secures cover member 114 in the closed position over the open face in housing or enclosure 112 and precludes unauthorized individuals from opening cover member 114 from the open face of housing or enclosure 112.

Figure 7:
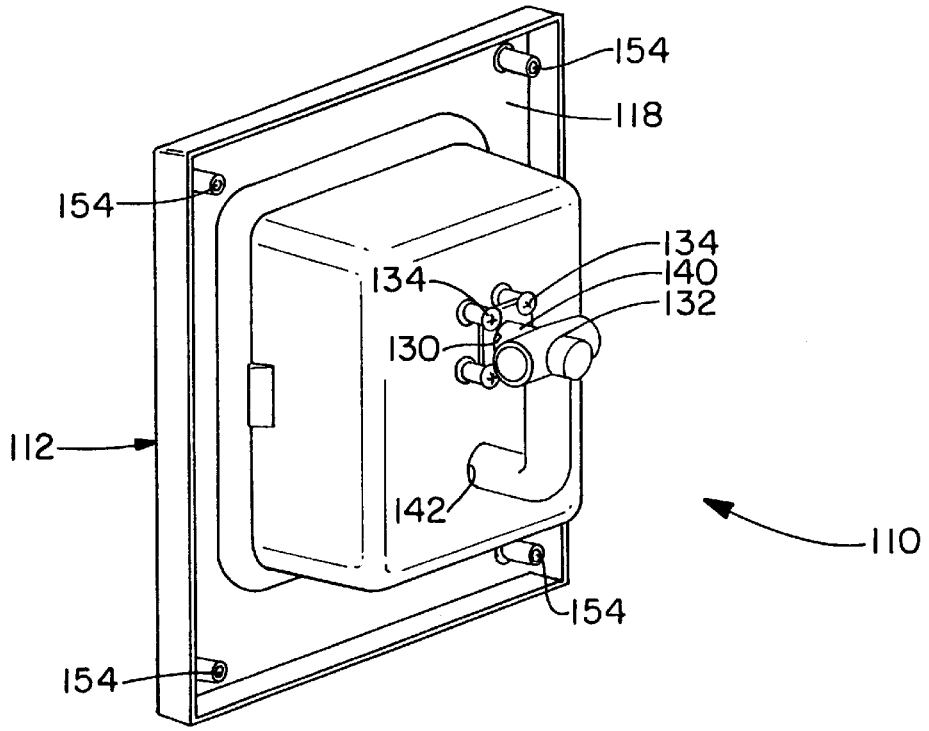
FIG. 7 illustrates a rear perspective view of an outdoor hot and cold water faucet assembly in accordance with the second preferred embodiment of the present invention shown in FIG. 5.
Figure 8:
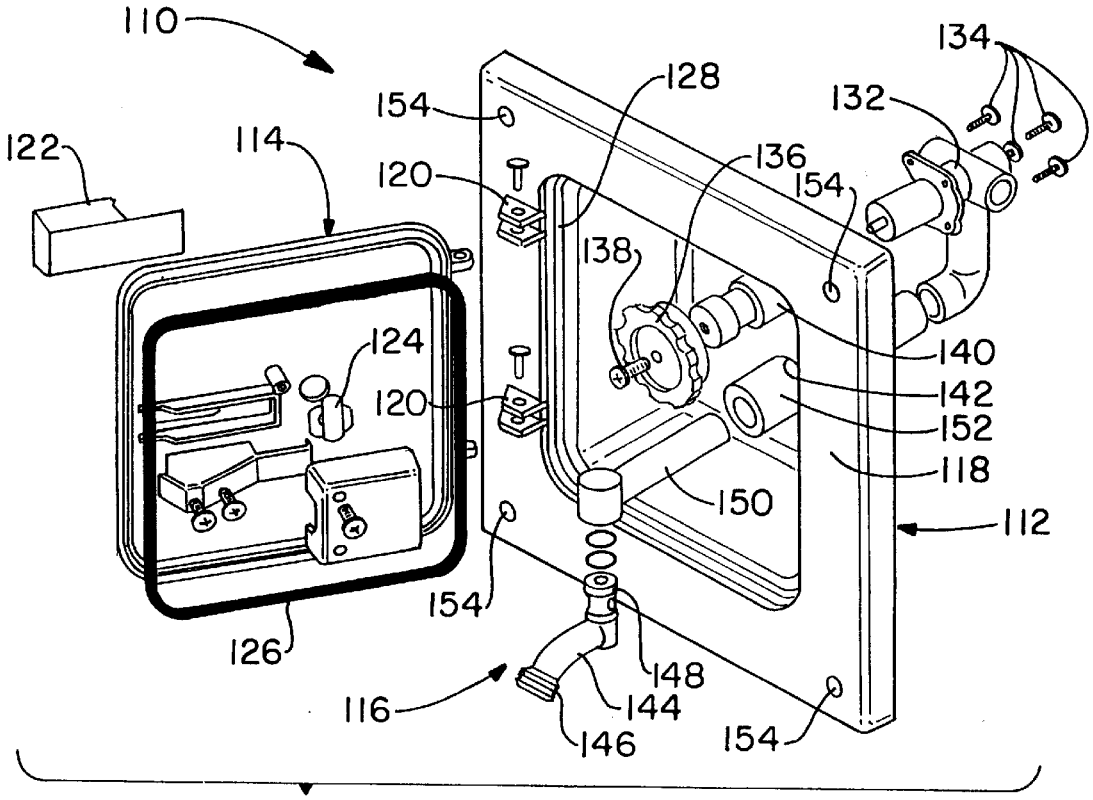
FIG. 8 illustrates an exploded front perspective view of an outdoor hot and cold water faucet assembly in accordance with the second preferred embodiment of the present invention shown in FIG. 5.

Sealing gasket 126 is preferably provided around the perimeter of the interior surface of cover member 114 and sealing gasket seals against recessed lip 128 preferably present in flange 118 of housing or enclosure 112. If desired, sealing gasket 126 could be retained in a groove extending around the perimeter of the interior surface of cover member 114. The back of housing or enclosure 112, opposite to its open face, includes opening 130, which is preferably molded, through which hot and cold water control valve 132 extends. Hot and cold water control valve 132 is preferably a single handle shower-type water control valve or similar water valve, but, alternatively, two (2) standard hot and cold water valves and a mixer could be utilized if desired. As seen in FIGS. 7 and 8, hot and water control valve 132 is preferably mounted to the outside of the back of housing or enclosure 112, preferably by screws 134 or some other fasteners. Hot and cold water control handle 136 is mounted outwardly of hot and cold water control valve 132 as seen in FIG. 8 by screw 138 or some other type of fastener and hot and cold water control handle 136 is preferably positioned inside of housing or enclosure 112. If desired, hot and cold water control valve 132 could be fitted with insulating sleeve 140 as shown in FIG. 8 to minimize thermal convection from the heated space into the interior of housing or enclosure 112.

The rear surface of housing or enclosure 112 preferably includes opening 142, which is preferably a molded opening, through which a section of hose bib pipe 144, preferably fabricated from a metallic material, extends. Hose bib pipe 144 preferably includes external threads 146, such as standard male hose threads, on its outer end and pivot surface 148 on its inner encl. Hose bib pipe 144 is capable of pivoting or "swiveling" from an outwardly extending position as shown in FIGS. 6 and 8 to a position substantially 90° degrees to either side such that when pivoted to a position substantially 90° from its outwardly extending position, hose bib pipe 144 is entirely positioned within housing or enclosure 112 and cover member 114 can be closed over the open face of housing or enclosure 112 to enclose and protect hose bib pipe 144 within housing or enclosure 112 to provide further thermal protection and protection against vandalism or mischief. The inner end of hose bib pipe 144 and the output of hot and cold water control valve 132 are preferably connected with sections of threaded pipe. At least one section of this connecting pipe is preferably fabricated from a non-metallic material, such as plastic, to provide a thermal barrier. This non-metallic pipe section 150 is preferably attached to the inner end of hose bib pipe 144 and at least a portion of hose bib pipe 144, as well as an adjoining section of non-metallic pipe section 150, is preferably enclosed in insulating sleeve 152 at least in the vicinity where hose bib pipe 144 and/or non-metallic pipe section 150 extend through flange 118 of housing or enclosure 112 to provide an additional thermal barrier between the outside and the inside of the structure on which outdoor hot and cold faucet assembly 110 is mounted. This thermal barrier between hose bib pipe 144 and hot and cold water control valve 132 prevents water from freezing in hot and cold water control valve 132 and also precludes the conduction of heat from the interior of the structure on which outdoor hot and cold faucet assembly 110 is mounted to the exterior through outdoor hot and cold faucet assembly 110.

Placement of hot and cold water control valve 132 behind housing or enclosure 112 places it on the "warm" side of the structure on which outdoor hot and cold water faucet assembly 110 is mounted and insulating sleeve 140 around hot and cold water control valve 132 further insulates hot and cold water control valve 132, thus insulating hot and cold water control valve 132 and hot and cold water supply lines (not shown) from outside temperatures and preventing freezing of water therein. In addition, the thermal barriers described above, along with housing or enclosure 112, preclude heat loss from the interior of the structure on which hot and cold water faucet assembly 110 is mounted. Cover member 114 also acts as an insulator for hot and cold water control valve 132, yet can be readily opened in any season to permit hot and/or cold water to be used outdoors. When cover member 114 is opened, hot and cold water control handle 136 can be opened and adjusted to cause the proper flow rate and temperature of water to pass through hot and cold water control valve 132. When cover member 114 is closed, hot and cold water control valve 132 is again insulated from the outside environment. Furthermore, when hot and cold water control valve 132 is closed, water drains from the output end of hose bib pipe 144 and its associated plumbing, thus preventing freezing of water in the sections of plumbing connecting hot and cold water control valve 132 with hose bib pipe 144. The face of housing or enclosure 112 is preferably provided with four (4) holes or openings 154 which can be used to mount housing or enclosure 112 into an opening in a structure measuring approximately eight (8) inches by eight (8) inches in, for example, a concrete block wall, a stud wall or to the band of a building. In addition, the rear portion of housing or enclosure 112 could be covered with Styrofoam or some other insulative material if desired to add further thermal protection and insulation.

Although the present invention has been described above in detail, the same is by way of illustration and example only and is not to be taken as a limitation on the present invention. For example, other arrangements for mounting outdoor hot and cold water faucet assembly 10 and 110 to a structure could be readily utilized in accordance with the teachings of the present invention. Accordingly, the scope and content of the present invention are to be defined only by the terms of the appended claims.

What is claimed is:

1. An outdoor water faucet assembly, comprising:

a housing or enclosure having an outwardly facing opening;

a cover member pivotally attached to said housing or enclosure, said cover member being capable of being closed on said outwardly facing opening in said housing or enclosure and also being capable of being opened from said outwardly facing opening to permit access to the interior of said housing or enclosure through said outwardly facing opening;

an outdoor water faucet having a water control valve and a water control handle, said water control handle being positioned in the interior of said housing or enclosure; and an outwardly extending hose bib pipe connected by connecting plumbing to said water control valve, said outwardly extending hose bib pipe being positioned exterior of said outwardly facing opening in said housing or enclosure.

2. The outdoor water faucet assembly in accordance with claim 1, wherein said cover member is pivotally attached to said housing or enclosure by at least one hinge.

3. The outdoor water faucet assembly in accordance with claim 2, further including a latch member mounted on said cover member to secure said cover member closed on said outwardly facing opening in said housing or enclosure.

4. The outdoor water faucet assembly in accordance with claim 3, further including a lock on said cover member to lock said cover member closed on said outwardly facing opening.

5. The outdoor water faucet assembly in accordance with claim 1, wherein at least a portion of said connecting plumbing is fabricated from a non-metallic material.

6. The outdoor water faucet assembly in accordance with claim 1, wherein said housing or enclosure includes a plurality of holes or openings to permit said outdoor water faucet assembly to be mounted onto a structure.

7. An outdoor hot and cold water faucet assembly, comprising:

a housing or enclosure having an outwardly facing opening;

a cover member pivotally attached to said housing or enclosure, said cover member being capable of being closed on said outwardly facing opening in said housing or enclosure and also being capable of being opened from said outwardly facing opening to permit access to the interior of said housing or enclosure through said outwardly facing opening;

an outdoor hot and cold water faucet having a hot and cold water control valve and a hot and cold water control handle, said hot and cold water control handle being positioned in the interior of said housing or enclosure; and a hose bib pipe connected by connecting plumbing to said water control valve, said hose bib pipe being pivotably movable from a first position extending substantially outwardly extending from said outwardly facing opening in said housing or enclosure to a second position substantially parallel to said outwardly facing opening in said housing or enclosure.

8. The outdoor hot and cold water faucet assembly in accordance with claim 7, wherein said cover member is pivotally attached to said housing or enclosure by at least one hinge.

9. The outdoor hot and cold water faucet assembly in accordance with claim 8, further including a latch member mounted on said cover member to secure said cover member closed on said outwardly facing opening in said housing or enclosure.

10. The outdoor hot and cold water faucet assembly in accordance with claim 9, further including a lock on said cover member to lock said cover member closed on said outwardly facing opening.

11. The outdoor hot and cold water faucet assembly in accordance with claim 7, wherein at least a portion of said connecting plumbing is fabricated from a non-metallic material.

12. The outdoor hot and cold water faucet assembly in accordance with claim 11, wherein at least a portion of said non-metallic pipe section is covered by an insulating sleeve.

13. The outdoor hot and cold water faucet assembly in accordance with claim 7, wherein said hose bib pipe is enclosed within said housing or enclosure when said cover member is closed upon said outwardly facing opening in said housing or enclosure.

14. The outdoor hot and cold faucet assembly in accordance with claim 7, further including an insulating sleeve positioned around at least a portion of said hot and cold water control valve.

15. The outdoor hot and cold water faucet assembly in accordance with claim 7, wherein said cover member includes a sealing gasket extending around the perimeter of the interior surface of said cover member, said sealing gasket seals with a recessed lip in a flange portion of said housing or enclosure when said cover member is closed on said outwardly facing opening in said housing or enclosure.

16. The outdoor hot and cold water faucet assembly in accordance with claim 7, wherein said hot and cold water control valve is a single handle shower-type hot and cold water control valve.

17. The outdoor hot and cold water faucet assembly in accordance with claim 7, wherein said hot and cold water control handle consists of two (2) standard hot and cold water control valves and a mixer.

18. The outdoor hot and cold water faucet assembly in accordance with claim 7, further including styrofoam insulating material on the rear surface of said housing or enclosure to provide further thermal protection and insulation.

19. The outdoor hot and cold water faucet assembly in accordance with claim 7, wherein said housing or enclosure includes a plurality of holes or openings to permit said outdoor hot and cold water faucet assembly to be mounted onto a structure.

20. An outdoor hot and cold water faucet assembly, comprising:

a housing or enclosure having an outwardly facing opening;

a cover member pivotally attached to said housing or enclosure, said cover member being capable of being closed on said outwardly facing opening in said housing or enclosure and also being capable of being opened from said outwardly facing opening to permit access to the interior of said housing or enclosure through said outwardly facing opening;

an outdoor hot and cold water faucet having a hot and cold water control valve and a hot and cold water control handle, said hot and cold water control handle being positioned in the interior of said housing or enclosure; and an outwardly extending hose bib pipe connected by connecting plumbing to said hot and cold water control valve, said outwardly extending hose bib pipe being positioned exterior of said outwardly facing opening in said housing or enclosure.

* * * * *